United States Patent [19]

Mauser

[11] 3,947,221

[45] Mar. 30, 1976

[54] PERSONAL PROTECTION DEVICE USING FLASHCUBES

[76] Inventor: Francis P. Mauser, 1014 Smithfield St., Parkersburg, W. Va. 26101

[22] Filed: Aug. 30, 1974

[21] Appl. No.: 502,019

[52] U.S. Cl. ..... 431/93; 240/1.3

[51] Int. Cl.[2] ..... F21K 5/02

[58] Field of Search ..... 431/92, 93; 240/1.3; 354/142, 141

[56] References Cited

UNITED STATES PATENTS

| | | | |
|---|---|---|---|
| 1,061,306 | 5/1913 | McColl | 431/92 |
| 1,930,315 | 10/1933 | Kobayashi | 431/93 X |
| 2,029,578 | 2/1936 | Maiser | 431/93 X |
| 3,687,033 | 8/1972 | Beach | 354/142 |
| 3,705,538 | 12/1972 | Putscher | 240/1.3 |
| 3,706,265 | 12/1972 | Simon | 431/93 |
| 3,785,260 | 1/1974 | Penick | 354/142 |
| 3,810,215 | 5/1974 | Armstrong | 431/93 |

FOREIGN PATENTS OR APPLICATIONS

| | | | |
|---|---|---|---|
| 635,443 | 8/1936 | Germany | 431/93 |

*Primary Examiner*—William F. O'Dea
*Assistant Examiner*—Harold Joyce
*Attorney, Agent, or Firm*—Berman, Aisenberg & Platt

[57] ABSTRACT

An attachment for converting a standard camera flashbulb unit into a personal defense device for use against criminals. The attachment consists of a support element adapted to be attached to a standard flashbulb unit, the support element being provided with a manually operable flexible trigger arm having a lug engageable through a slot in the bottom of the flashbulb unit with the cocked percussion spring of the unit to release the spring and cause it to fire the unit. The attachment is provided with an outwardly projecting carrying ring to facilitate transportation and handling of the flashbulb unit when the attachment is operatively connected thereto. In one form of the attachment it can rotatably receive the bottom base post of the flashbulb unit and allow the various flash sections of a multiple-flash unit to be successively fired. In another form of the attachment it can be connected to the flashbulb unit for single triggering action.

13 Claims, 9 Drawing Figures

PERSONAL PROTECTION DEVICE USING FLASHCUBES

This invention relates to personal defense devices, and more particularly to a device adapted to be carried by an individual and which can be operated to provide a blinding flash so as to temporarily incapacitate a criminal or other assailant so as to enable an individual to escape or call for assistance while the assailant is incapacitated.

A main object of the invention is to provide a novel and improved personal defense device adapted to be easily carried by an individual for temporarily blinding a criminal or other assailant, the device employing as a component thereof a standard flashbulb unit and being arranged so that it can be easily carried by an individual and readily operated to temporarily blind an attacker, the device being compact in size, being easy to assemble, and being instantaneously operable.

A further object of the invention is to provide an improved personal defense attachment which can be employed with a standard camera flashcube, the attachment involving very simple parts, being convenient to carry when it is attached to a flashcube unit, and being readily transferrable from a used flashcube unit to a new one.

A still further object of the invention is to provide an improved personal defense device of the type which provides a blinding flash which can be employed by an individual to temporarily blind an assailant, the attachment being adapted to be easily carried by an individual and being very easy to operate, enabling the individual to temporarily blind a criminal or other assailant so as to facilitate the individual's escape or to provide the individual with time to call for assistance.

Further objects and advantages of the invention will become apparent from the following description and claims, and from the accompanying drawings, wherein:

Figure 1:
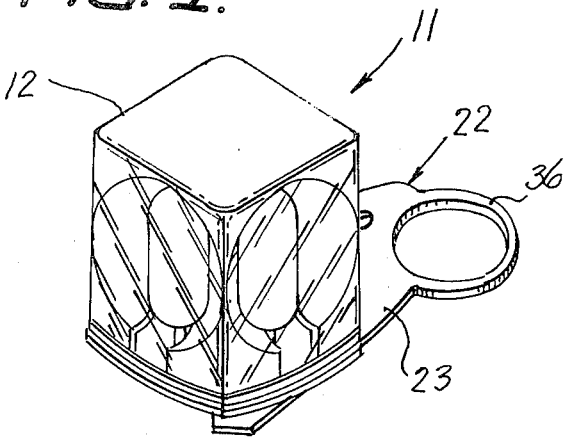
FIG. 1 is a perspective view of an improved personal defense device constructed in accordance with the present invention.

Referring to the drawings, and more particularly to FIGS. 1, 2, 3, 8 and 9, 11 generally designates an improved personal defense device according to the present invention. The device 11 employs a standard flashbulb unit 12, for example, a multiple-flash unit such as the "Magi-Cube," manufactured by General Electric Company, Nela Park, Cleveland, Ohio 44112. This flashcube unit has a transparent generally cubical casing 13 secured on a generally square base 14, the base being formed with an integral central post element 15 having a central bore 16. Mounted on this base are four percussive-packed flashbulb elements 17, evenly spaced around the central axis of the device, namely, the axis of post element 15, each flashbulb element 17 being provided with a primer tube 18 which is located adjacent an arcuate slot 19 provided in base 14. Overlying the slot 19 is a resilient striker arm 20 which is normally in cocked position against standing pin 21 in the manner illustrated in FIG. 8. When the striker arm 20 moves upwardly to disengage from the detent element 21, the tension therein causes it to strike the tube 18 and detonate the bulb 17.

The structure of the flashbulb unit 11 is conventional per se, and this unit is commercially available. Further details of the structure of this type of flashbulb unit will be found in U.S. Pat. No. 3,597,603 to Thomas B. McDonough, issued Aug. 3, 1971.

Figure 8:
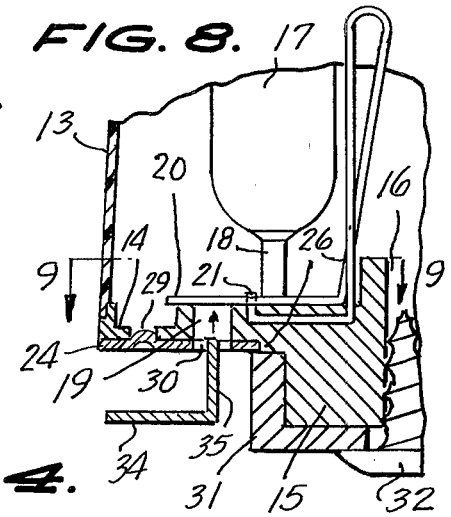
FIG. 8 is an enlarged fragmentary cross-sectional view taken substantially on the line 8—8 of FIG. 2.

A typical personal defense attachment according to the present invention is designated generally at 22. The attachment 22 comprises a main supporting plate member 23 which has a main body portion 24 shaped to conformably receive the base 14 of a flashbulb unit 12, the plate member being provided with a circular aperture 25 adapted to receive the post portion 15 of the standard flashbulb unit 12, and to rotatably receive a shoulder portion 26 provided around the post element 15, as shown in FIG. 8.

In the conventional flashbulb unit 12 above described, the base portion 14 is provided with corner apertures 27. The portion 24 of plate member 23 is provided with upwardly deformed projections 29 yieldably engageable in the apertures 27 to serve as detent means for holding the plate member 23 in definite operating positions relative to the flashcube member 12 for a purpose presently to be described, the plate member 23 being of sheet metal or other somewhat resilient sheet material, to allow the flashcube unit 12 to be rotated from one operating position to the next successive operating position, as will be also presently described.

Plate portion 24 is formed with an arcuate slot 30 registrable with the slots 19 of base 14 in the various operating positions of the attachment 22. Thus, in the embodiments of FIGS. 1, 2, 3, 8 and 9, a cap member 31 receives the post portion 15 and the fastening screw 32 engages through a central aperture in the cap member and is threadedly engaged in the bore 16, the screw 32 being of the sheet metal type which forms its own threads. As shown in FIG. 8, the cap member 31 bears on the shoulder 26 acts as a retention means for the plate portion 24 since it overlaps the portion of plate 24 around the aperture 25.

Figure 2:
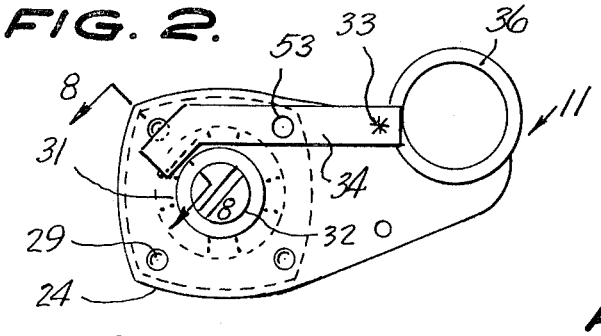
FIG. 2 is a bottom plan view of the personal defense device shown in FIG. 1.
Figure 3:
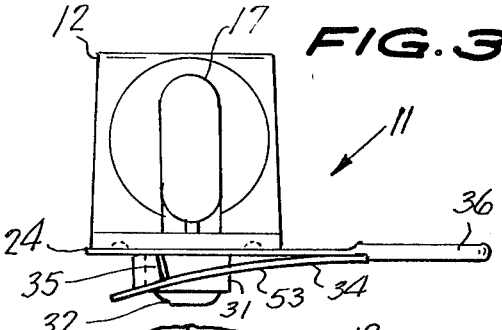
FIG. 3 is a side elevational view of the device of FIGS. 1 and 2.

Secured to the other portion of plate member 23, as by a weld 33, FIG. 2, is a flexible arm 34 which extends beneath the portion 24, as shown in FIG. 3, and which is provided with an upstanding lug 35 in registry with the slot 30 and of sufficient length to operatively engage the striker arm 20 when it is pushed upwardly through the slot 19. Thus, to fire a flashbulb unit 17 with the attachment 22 secured to the flashcube assembly 12, it is merely necessary to push upwardly on the free end portion of the flexible arm 34, causing the lug 35 to move striker arm 20 out of engagement with detent pin element 21 and release striker arm for impact with the percussive primer tube 18.

The outer end portion of plate member 23 may be provided with an integral carrying ring 36 to enable the personal defense device 11 to be carried on the user's finger in a position to allow another finger of the same hand to operatively engage the flexible arm 34, or alternatively, enabling the device to be carried on a necklace, or the like.

After one of the flashbulb elements 17 has been fired, another flashbulb element may be brought into operating position by rotating the assembly 12 ninety degrees relative to the plate member 23, the detent elements 29 being movable relative to the corner apertures 27 of base 14 to allow rotation of unit 12 from one operating position to the next.

Figure 4:
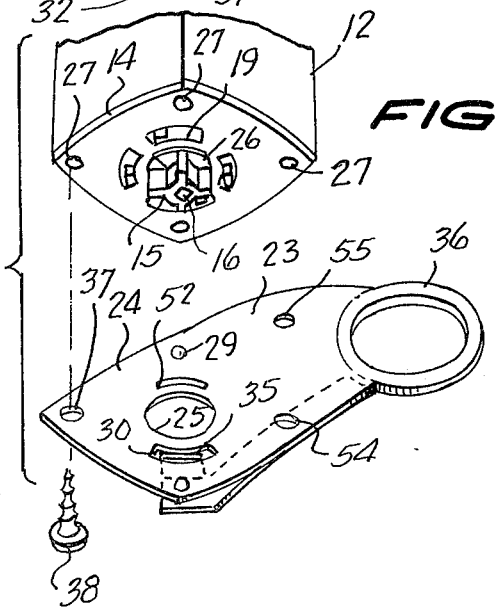
FIG. 4 is a fragmentary perspective view showing the parts of the device of FIGS. 1, 2 and 3, in separated positions, and illustrating the alternative manner of fastening the triggering attachment to the flashbulb unit of the assembly.
Figure 9:
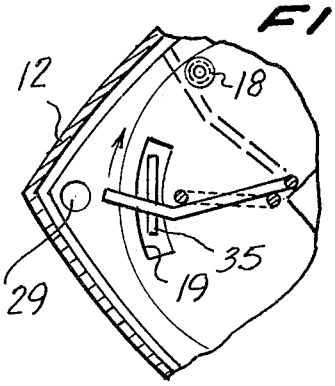
FIG. 9 is a horizontal cross-sectional view taken substantially on the line 9—9 of FIG. 8.

FIG. 4 illustrates an alternative mode of connection of plate member 23 to the flashbulb assembly 12, wherein an aperture 37 is provided at a corner portion of plate member 23 in place of one of the detent elements 29, and wherein a sheet metal screw 38 is engaged through the aperture 37 and is threadedly engaged in one of the corner apertures 27 of the base 14 of the flashcube assembly 12. In this arrangement, the post member 15 extends through the aperture 25 of plate member 23, but the attachment is rigidly held relative to the flashcube assembly 12 so that the flashcube assembly 12 is not rotatable relative to plate member 23. With this arrangement, in order to rotate the flashcube assembly 12 to the next firing position, it is necessary to first unfasten the screw 38, whereby the assembly 12 can be rotated ninety degrees, after which the screw 38 is reinserted through the aperture 37 and threadedly engaged in a corner aperture 27 of the base portion 14 of flashcube assembly 12. The arm 34 and plate member 23 have openings 53 and 54 which, if desired, may be used to secure the plate member 23 to the flashbulb unit 12 by a fastener, like screw 38, but in a manner described below in connection with FIG. 5. This would convert the embodiment of FIG. 3 into a single flash unit. The hole 55 may be used to mount the plate member on objects, such as doors for activation by a moving object, or perhaps to hang from the neck or wrist of a user.

Figure 5:
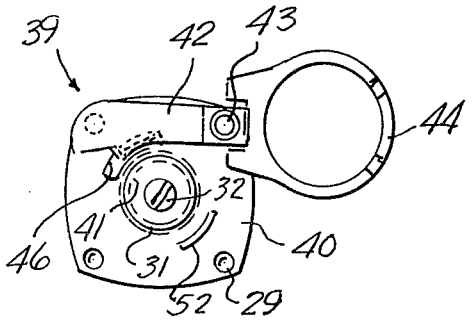
FIG. 5 is a bottom plan view of an alternative form of attachment according to the present invention employed with a standard camera flashbulb unit.
Figure 6:
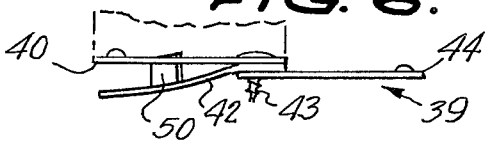
FIG. 6 is a side elevational view of the form of triggering attachment shown in FIG. 5.

Referring now to FIGS. 5 and 6, a modified form of personal defense attachment for use with a standard flashbulb unit is designated generally at 39 and comprises a main supporting plate member 40 substantially identical in shape with the bottom wall 14 of a standard flashbulb unit and having a central aperture 41 to receive the post member 15 of such a unit 12. A flexible trigger arm 42 is secured at one end thereof by a fastening screw 43 to a corner portion of the plate member 40, and a holding ring element 44 is similarly secured by the fastening screw 43 to the corner portion of said plate member. The ring member 44 may be similar to that employed with a standard disposable beverage can, having a tab element 45 which is apertured to receive the fastening screw 43. It will be further apparent that the flexible trigger arm 42 and ring member 44 may comprise a normally discarded torn off beverage tab portion so that this portion of the attachment may utilize such discarded pieces and thereby constitute means for economical disposal of such pieces. The flexible arm portion 42 is formed with the upstanding trigger lug 50, similar to the trigger lug 35 in the previously described form of the invention, which is located to register with an arcuate slot 19 in the bottom wall of a standard flashbulb unit 12, and an arcuate slot 46 in plate member 40 for passage therethrough. The plate member 40 may be secured to the center post 15 of a standard flashbulb 12 in the same manner as in a previously described embodiment of the invention, namely, by the use of a retaining cap member 31 and screw 32, or, alternately, may be merely frictionally engaged on the post element 15 of the flashbulb unit. As in the previously described form of the invention, the plate member 40 is formed with corner projections or indentations 29 registering with the corner apertures 27 in the bottom wall of a standard flashbulb unit 12, and an arcuate detent 52 to fit in a slot 19.

Figure 7:
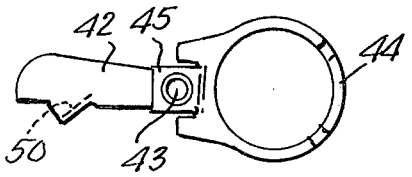
FIG. 7 is a plan view of another embodiment of a triggering attachment which may be employed to form a personal defense device according to the present invention.

FIG. 7 discloses still another form of attachment according to the present invention, comprising merely a finger gripping element 44 to which is secured a flexible trigger arm 42 having the trigger lug 50, similar to that shown in FIGS. 5 and 6, and adapted to be secured by a fastening screw 43 to a corner portion of the bottom wall 14 of a standard flashbulb unit 12; for example, by engaging the fastening screw 43 through a corner aperture 27 of a flashbulb unit bottom wall 14. As in the form of the invention shown in FIGS. 5 and 6, the attachment of FIG. 7 may be fabricated from the torn off tab portion of a beverage can, to thereby provide economical utilization of such a torn off tab portion, which would otherwise be discarded, and result in undesirable litter.

In the various embodiments disclosed above, the attachment is secured to a standard flashbulb unit 12 in the manner above described, and in order to fire the flashbulb unit, it is merely necessary to exert upward pressure on the resilient trigger arm to thereby urge the lug carried thereon into operating engagement with the striker arm 20 to thereby release the striker arm and allow it to strike the percussion tube element 18 and fire the associated flashbulb 17.

As will be readily apparent from the above discussion, it is possible to fabricate a firing attachment for a standard flashbulb unit by utilizing the torn off tab portion of a beverage container, such tab portions being heretofore discarded and presenting problems to the environment since they are difficult to retrieve from the ground, especially in inconvenient locations. The present invention therefore creates a use for such previously discarded items and also contributes to protection of the environment by giving the previously discarded torn off tab portions some economic value.

While certain specific embodiments of an improved personal defense device of the flashbulb type have been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. A personal defense attachment for use with a flashbulb unit of the type including a casing and at least one flashbulb having percussive flash means with a percussion striker arm engaging a detent which can fire the bulb responsive to movement of the striker arm off the detent, the casing having an aperture adjacent the striker arm, said attachment comprising a flexible arm, means to secure said flexible arm to the casing, a trigger lug on the flexible arm engageable through said aperture and being of sufficient length to engage the striker arm and move it off the detent when the flexible arm is flexed toward the aperture in the casing, a carrying ring, and means securing said carrying ring to the flexible arm in a position such as to allow a user's finger to be engaged therein and so that another finger on the same hand is operatively engageable with said flexible arm to flex said arm toward said aperture.

2. The personal defense attachment of claim 1, and wherein the means to secure the flexible arm to the casing comprises a plate member carrying the flexible arm, and means to fasten said plate member to the casing.

3. The personal defense attachment of claim 1, and wherein the means to secure the flexible arm to the casing comprises a plate member carrying the flexible arm, and means to rotatably connect said plate member to the casing in a position wherein said lug can be registered with said aperture.

4. The personal defense attachment of claim 3, and wherein said carrying ring is secured to an outer end portion of said plate member.

5. A personal defense device comprising the combination of a flashbulb unit and an attachment therefore, said unit including a casing and at least one flashbulb having percussive flash means with a percussion striker arm engaging a detent which can fire the bulb responsive to movement of the striker arm off the detent, the casing having an aperture adjacent the striker arm, said attachment comprising a flexible arm, means to secure said flexible arm to the casing, a trigger lug on the flexible arm engageable through said aperture and being of sufficient length to engage the striker arm and move it off the detent when the flexible arm is flexed toward the aperture in the casing, a carrying ring, and means securing said ring to said flexible arm in a position such as to allow a user's finger to be engaged therein and so that another finger on the same hand is operatively engageable with said flexible arm to flex said arm toward said aperture.

6. The personal defense device of claim 5, and wherein the means to secure the flexible arm to the casing comprises a plate member carrying the flexible arm, and means to fasten said plate member to the casing.

7. The personal defense device of claim 5, and wherein the means to secure the flexible arm to the casing comprises a plate member carrying the flexible arm, and means to rotatably connect said plate member to the casing in a position wherein said lug can be registered with said aperture.

8. The personal defense device of claim 7, and wherein said carrying ring is secured to an outer end portion of said plate member.

9. The personal defense device of claim 6, and wherein the casing is provided with a center post on said axis and the plate member has an opening receiving said center post.

10. The personal defense device of claim 9, and retaining cap means secured to said center post and retentively engaging said plate member.

11. The personal defense device of claim 6, and wherein said carrying ring is secured to an outer end portion of the plate member.

12. The personal defense device of claim 5, and wherein said flashbulb unit is of the multiple flash type having a plurality of flash bulbs, each provided with identical percussive flash means, each having a resilient and tensed percussion arm engaging a detent which can fire the associated bulb responsive to movement of the percussion arm off its detent, the casing having respective apertures adjacent the percussion arms, and wherein the means to secure the flexible arm to the casing comprises a plate member carrying the flexible arm, and means to rotatably secure the plate member to the casing for rotation around an axis centered relative to said apertures, the trigger lug being at the same radial distance from said axis as said apertures.

13. The personal defense device of claim 12, and interengaging yieldable detent means on the plate member and casing located to align the lug with the respective apertures in the various firing positions of the flexible arm.

* * * * *